US009261340B2

(12) United States Patent
Bliss et al.

(10) Patent No.: US 9,261,340 B2
(45) Date of Patent: Feb. 16, 2016

(54) PROTECTIVE CANISTERS FOR INCENDIARY DEVICES

(71) Applicant: Drew Marine Signal and Safety US LLC, Whippany, NJ (US)

(72) Inventors: William R. Bliss, Newark, DE (US); Thomas R. Cessario, Elkton, MD (US)

(73) Assignee: DREW MARINE SIGNAL AND SAFETY US LLC, Whippany, NJ (US)

( * ) Notice: Subject to any disclaimer, the term of this patent is extended or adjusted under 35 U.S.C. 154(b) by 0 days.

(21) Appl. No.: 14/340,040

(22) Filed: Jul. 24, 2014

(65) Prior Publication Data

US 2015/0027333 A1 Jan. 29, 2015

Related U.S. Application Data

(60) Provisional application No. 61/857,796, filed on Jul. 24, 2013.

(51) Int. Cl.

| | |
|---|---|
| ***F42B 4/26*** | (2006.01) |
| ***F42B 39/20*** | (2006.01) |
| ***F42B 39/18*** | (2006.01) |

(52) U.S. Cl.

CPC ..... *F42B 39/20* (2013.01); *F42B 39/18* (2013.01)

(58) Field of Classification Search

CPC ..... F42B 39/00; F42B 4/26; F42B 4/28
USPC ..... 102/335–338, 293; 86/47
See application file for complete search history.

(56) References Cited

U.S. PATENT DOCUMENTS

| | | | | |
|---|---|---|---|---|
| 4,817,828 | A * | 4/1989 | Goetz | B60R 21/2171 102/288 |
| 4,860,657 | A * | 8/1989 | Steinicke et al. | F42B 4/06 102/285 |
| 5,499,582 | A * | 3/1996 | Schiessl et al. | F42B 4/06 102/285 |
| 2011/0179967 | A1* | 7/2011 | Yamazaki et al. | B60R 21/2644 102/530 |
| 2014/0144340 | A1* | 5/2014 | Smith et al. | B60R 21/2644 102/202.9 |

* cited by examiner

*Primary Examiner* — Michael David
(74) *Attorney, Agent, or Firm* — Buchanan Ingersoll & Rooney PC

(57) ABSTRACT

In one aspect, the present disclosure relates to protective canisters for incendiary devices, said canisters comprising a sidewall and two endcaps, said endcaps attached to said sidewall so as to form a substantially enclosed canister; wherein one or both of said endcaps is removably attached to said sidewall; and wherein said sidewall comprises a plurality of transverse holes through it. Optionally, one or both of said endcaps comprise one or more transverse holes through them.

17 Claims, 11 Drawing Sheets

PROTECTIVE CANISTERS FOR INCENDIARY DEVICES

CROSS REFERENCE TO RELATED APPLICATION

This application claims the benefit of U.S. Provisional Application Ser. No. 61/857,796, filed Jul. 24, 2013, the contents of which are herein incorporated by reference in their entirety.

FIELD OF THE DISCLOSURE

The present disclosure relates to protective canisters for incendiary devices, such as signal flares or fireworks.

BACKGROUND

Numerous types of relatively small, such as hand-held, incendiary devices are routinely used in various industries and settings. For example, many marine vessels carry aerial pyrotechnic flares, or parachute flares, for use as a distress signal. And, in fact, many vessels are required by law to carry such signal flares. These flares possess multiple pyrotechnic charges, including a propulsion charge that launches the flare into the air (frequently to altitudes of 1000 feet or more) and a flare charge that burns at high intensity for an extended period of time to alert others of the distress.

Similarly, many land vehicles carry signal flares, either parachute flares (for example, for off-road vehicles) or road flares (for example, for typical passenger vehicles). Additionally, fireworks are sold to both consumers and professional display companies in many states across the U.S. and in numerous countries worldwide.

Incendiary devices such as these pose particular challenges for transport and storage. For instance, if a parachute flare were to inadvertently ignite during transport or storage, it is necessary to ensure that the propulsion charge does not cause the flare to become a moving projectile. If it were to become such a projectile, it would pose dangers to persons and cargo in the vicinity, both from the risk of the flare itself striking a nearby individual or object and causing physical damage, and from the risk that the burning flare may cause a fire at a remote location, or spread a fire to a remote location. However, because many of these types of incendiary devices are used in emergency situations, it is also necessary that they can be easily accessed and used.

Thus, there remains a need in the art for improved protective canisters for incendiary devices.

SUMMARY OF THE DISCLOSURE

The present inventors have developed a protective canister for incendiary devices that confers certain advantages over prior art designs. The protective canisters of the present application provide superior protection in a relatively light-weight and economical design, while also allowing the device to be readily accessed by the user.

In one aspect, the present application relates to a protective canister for incendiary devices, said canister comprising a circumferential sidewall and two endcaps, the endcaps being attached to the sidewall so as to form a substantially enclosed canister; wherein one or both of the endcaps is removably attached to the sidewall; and wherein the sidewall comprises a plurality of transverse holes through it. In certain embodiments, the removably attached endcap is a screw-on endcap.

In additional embodiments, one or both endcaps further comprises one or more transverse holes through it.

In certain embodiments, the circumferential sidewall is constructed from a substantially flat sheet of material which has been bent such that two opposing edges of the sheet are in contact with each other along a seam, thereby creating the circumferential sidewall. The two opposing edges can be held together at the seam by any suitable means, and such suitable means would be readily known to persons skilled in the art. In certain examples, the seam may be held together by a continuous weld running along the seam. In other examples, the seam may be held together by a seam fold or seam lock (e.g., a grooved seam or single lock seam). In further examples, the seam may be held together by a plurality of spot welds. In still further examples, the seam may be held together using a combination of a seam fold and a plurality of spot welds.

In further embodiments, the canister contains between 1 and 10 incendiary devices enclosed within it. In certain examples, the canister contains a single incendiary device enclosed within it, while in other examples it contains 2, 3, 4, 5, 6, 7, 8, 9, 10, or more incendiary devices within it. In certain examples, the incendiary devices are hand-held incendiary devices. In other examples, the incendiary devices are signal flares. In particular examples, the incendiary device is a parachute flare or a road flare. In further examples, the incendiary devices within the canister comprise a total of 0.01-2 kg of pyrotechnic charge material, while in other examples the incendiary devices within the canister comprise a total of 0.08-0.2 kg of pyrotechnic charge material.

In some embodiments the canister sidewall is formed into a substantially cylindrical shape while in other examples the sidewall is formed into a different shape, such as a polygon shape.

In further embodiments, the canister comprises 4-100 transverse holes, while in other examples the canister comprises 6-24 transverse holes. In certain examples, each of the transverse holes comprises a diameter of about 0.125-1.0", while in other examples each of the transverse holes comprises a diameter of about 0.25-0.5".

In certain embodiments, the canister contains one or more incendiary devices enclosed within it, and the canister has a hole:pyrotechnic ratio of between about 5 $in^2$/kg and about 150 $in^2$/kg. In certain examples, the canister has a hole:pyrotechnic ratio of between about 10 $in^2$/kg and about 30 $in^2$/kg.

In other embodiments, the transverse holes are arranged in 2-10 rows along the length of the canister sidewall with each row containing 2-10 transverse holes, with the transverse holes in each row being substantially evenly spaced around the circumference of the canister sidewall. In further embodiments, the transverse holes are arranged in one or more spiral patterns along the length and around the circumference of the canister sidewall. In additional embodiments, the rows of holes are arranged along the length of the canister sidewall such that they substantially align with the major pyrotechnic charges within the incendiary device.

In certain embodiments, the canister is constructed substantially of steel. In certain examples, the steel material has a thickness of about 5 to about 20 mils, while in other examples the steel material has a thickness of about 10 mils.

In further embodiments, the canister contains one or more incendiary devices enclosed within it, and the canister has a canister:device volume ratio of about 1.5 to about 10. In certain examples, the canister has a canister:device volume ratio of about 2 to about 5.

In another aspect, the present application relates to a protective canister for incendiary devices, comprising a circumferential sidewall and two endcaps; wherein said sidewall is formed into a substantially cylindrical shape, and wherein said endcaps are attached to said sidewall so as to form a substantially enclosed canister; wherein one of said endcaps is removably attached to said sidewall, said removable attachment being a screw-on attachment; wherein said sidewall and endcaps are constructed substantially of steel, said steel having a thickness of about 10 mils; wherein said canister contains a parachute flare enclosed within it, said parachute flare comprising about 0.08-0.2 kg pyrotechnic charge material; wherein said sidewall comprises 6-24 transverse holes through it; wherein said transverse holes are arranged in 2-6 rows along the length of the canister sidewall with each row containing 2-6 transverse holes, said transverse holes in each of said rows being substantially evenly spaced around the circumference of the sidewall; wherein said rows are arranged along the length of the canister sidewall such that they substantially align with the major pyrotechnic charges within the incendiary device; wherein each of said transverse holes comprises a diameter of about 0.25-0.5"; wherein said canister has a hole area to pyrotechnic charge material ratio of about 10 $in^2$/kg to about 30 $in^2$/kg; and wherein said canister has a canister volume to incendiary device volume ratio of about 2 to about 5.

In yet another aspect, the present application relates to a method for transporting or storing an incendiary device, the method comprising placing an incendiary device within a canister as described in the present application.

BRIEF DESCRIPTION OF THE DRAWINGS

FIG. 1A illustrates a canister possessing a total of 4 transverse holes through the canister sidewall, the holes being present in 2 rows with the holes in each row substantially diametrically opposed (approximately 180° apart) around the circumference of the sidewall. FIG. 1B illustrates a canister possessing a total of 6 transverse holes through the canister sidewall, the holes being present in 3 rows with the holes in each row substantially diametrically opposed (approximately 180° apart) around the circumference of the sidewall. FIG. 1C illustrates a canister possessing a total of 18 transverse holes through the canister sidewall, the holes being present in 3 rows of 6 holes each, with the holes within each row spaced substantially evenly around the circumference of the canister sidewall such that the holes are approximately 60° apart. FIG. 1D illustrates a canister possessing a total of 40 transverse holes through the canister sidewall, the holes being present in 5 rows of 8 holes each, with the holes within each row spaced substantially evenly around the circumference of the canister sidewall such that they are approximately 45° apart. FIG. 1E illustrates a canister possessing a total of 6 transverse holes through the canister sidewall, the holes being present in a spiral pattern that extends along the length and around the circumference of the canister sidewall. FIG. 1F illustrates a canister possessing a total of 24 transverse holes through the canister sidewall, the holes being present in a dual-spiral pattern that extends along the length and around the circumference of the canister sidewall.

FIG. 3A illustrates an endcap with no transverse holes. FIG. 3B illustrates an endcap with a four transverse holes, including a larger center hole surrounded by three smaller holes in a triangle pattern. FIG. 3C illustrates an endcap with 3 transverse holes in a triangular pattern.

FIG. 4A illustrates a cross section at line 4A-4A of the canister of FIG. 1C, with the canister containing a single incendiary device. FIG. 4B illustrates a cross section at line B-B of the canister of FIG. 1D, with the canister containing three incendiary devices. FIG. 4C illustrates a cross section at line 4C-4C of the canister of FIG. 1C, with the canister containing a single incendiary device.

DETAILED DESCRIPTION

Figure 1A:
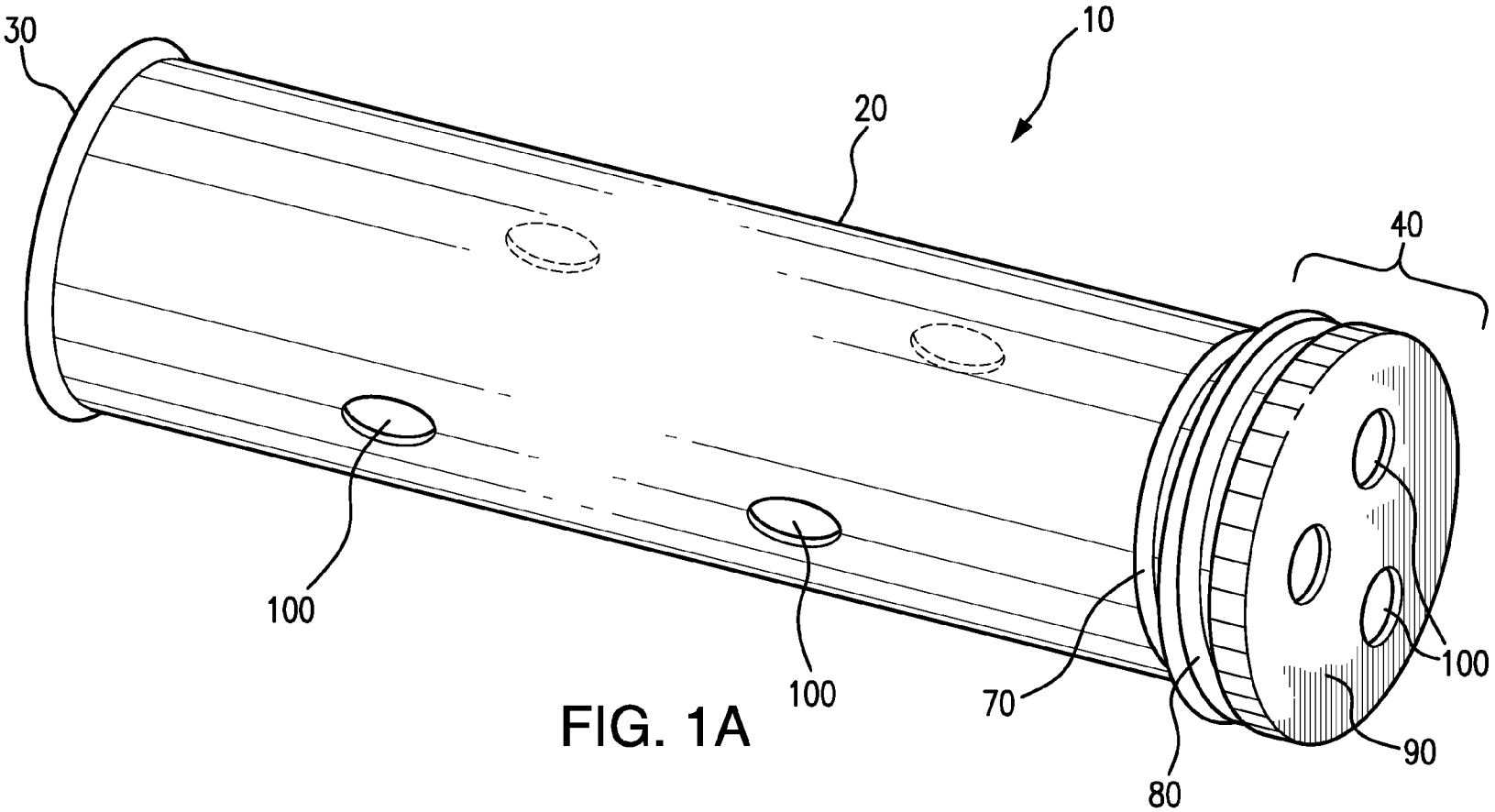
FIGS. 1A-1F provide perspective views of canisters of the present application, each canister possessing a cylindrical shape with a screw-on top endcap, the top endcap containing 3 transverse holes through it in a triangular pattern.

It is to be understood that this disclosure is not limited to particular embodiments, which can, of course, vary. It is also to be understood that the terminology used herein is for the purpose of describing particular embodiments only, and is not intended to be limiting. Unless defined otherwise, all technical and scientific terms used herein generally have the same meaning as commonly understood by one of ordinary skill in the art to which this disclosure belongs.

As used in this specification and the appended claims, terms in the singular and the singular forms "a," "an," and "the," for example, include plural referents unless the content clearly dictates otherwise. Thus, for example, reference to "hole," "the hole" or "a hole" also includes a plurality of holes. Additionally, as used herein, the term "comprises" is intended to indicate a non-exhaustive list of components or steps, thus indicating that the given composition or method includes the listed components or steps and may also include additional components or steps not specifically listed. As an example, an apparatus "comprising steel" may also include additional materials, such as aluminum, brass, or metal alloy. The term "comprising" is also intended to encompass embodiments "consisting essentially of" and "consisting of" the listed components or steps. Similarly, the term "consisting essentially of" is also intended to encompass embodiments "consisting of" the listed components or steps.

Numeric ranges recited within the specification and claims are inclusive of the numbers defining the range (the end point numbers) and also are intended to include each integer or any non-integer fraction within the defined range. Further, as used herein, the term "about" refers to a number that differs from the given number by less than 10%. In other embodiments, the term "about" indicates that the number differs from the given number by less than 9%, 8%, 7%, 6%, 5%, 4%, 3%, 2%, or 1%.

The present inventors have developed a protective canister for incendiary devices that confers certain advantages over prior art designs. The protective canisters of the present application provide superior protection in a relatively light-weight and economical design, while also allowing the device to be readily accessed by the user.

Throughout this detailed description, reference will be made to the canisters illustrated in FIGS. 1-5 and the reference numerals provided therein. These figures are provided only as examples of designs of the present application and are not intended to be limiting.

A canister 10 of the present invention possesses a sidewall 20, a bottom endcap 30, and a top endcap 40. The canister can be any suitable shape for containing the desired incendiary device. In certain embodiments the canister will comprise a sidewall 20 formed into a substantially cylindrical shape with two endcaps 30 and 40 that are substantially circular in shape so as to substantially enclose the canister (see, e.g., FIGS. 1A-1F). In other examples, the sidewall could be formed into a different shape, such as a triangular shape, square shape, or a regular polygon shape possessing 5, 6, 7, 8, 9, 10, 11, 12, or more sides, with the end caps possessing a corresponding shape such that they are able to substantially enclose the canister. For instance, the canister shown in FIG. 2 has a sidewall 20 that has been formed into an octagonal shape and has corresponding octagonal-shaped endcaps 30 and 40.

In certain embodiments, the circumferential sidewall is constructed from a substantially flat sheet of material which has been bent such that two opposing edges of the sheet are in contact with each other along a seam, thereby creating the circumferential sidewall. The two opposing edges can be held together at the seam by any suitable means, and such suitable means would be readily known to persons skilled in the art. In certain examples, the seam may be held together by a continuous weld running along the seam, such as an overlap weld. In other examples, the seam may be held together by a seam fold or seam lock (e.g., a grooved seam or single lock seam). In further examples, the seam may be held together by a plurality of spot welds. In still further examples, the seam may be held together using a combination of a seam fold and a plurality of spot welds.

In certain examples, one or both end caps of the canister contain a detachment means, such as a latch mechanism or screw threads. In certain examples, the detachment means is operable without the need for tools. For example, the canister shown in FIG. 3 possesses a detachable top endcap 40 which possess a hinge region 50 and a latch mechanism 60. This allows the incendiary device to be inserted into or removed from canister 10 by operating latch mechanism 60 and then swinging top endcap 40 open via hinge region 50 so as to open the canister. In certain examples, one or both ends of the canister sidewall contain screw threads and the corresponding endcap(s) possesses a threaded region with mating screw threads. In such examples, the sidewall may comprise the male portion of the threads with the endcap comprising the female portion, or the sidewall may comprise the female portion of the threads with the endcap comprising the male portion. For example, the canister shown in FIGS. 4C and 5 possess a sidewall 20 with a male threaded region 70 in the vicinity of the sidewall adjacent to top endcap 40. Top endcap 40 possesses an end portion 90 and a mating threaded region 80 substantially perpendicular and adjacent thereto. This allows endcap 40 to be attached to sidewall 20 by threading the endcap onto the canister, thereby interlocking threaded regions 70 and 80 and substantially enclosing canister 10. The canisters shown in FIGS. 1A-1F also possess mating threaded regions 70 and 80, thereby allowing endcap 40 to be threaded onto and off of the canisters. (See also FIGS. 3A-3C).

The canisters of the present invention can be constructed of any material capable of withstanding the heat and pressure imparted to the canister during the burning of the incendiary device within the canister, as well as withstanding erosion of the material caused by gas exiting the holes within the canister. Persons skilled in the art would be able to readily determine an appropriate material type for their particular need. In certain examples, the canister is made of a metal, polymeric material, composite material, carbon fiber, or fiberglass material. In particular examples, the canister is constructed of steel, for example cold-rolled steel. In certain examples, the canister is made entirely or substantially of one type of material. In other examples, the canister is made of more than one material type. For instance, the canister can possess a carbon fiber sidewall with steel end caps, or can be made of an inner layer of steel surrounded by a carbon-fiber outer layer.

The thickness of the material from which the canister is constructed is also an important factor to take into consideration when selecting an appropriate material from which to construct the canister. Persons skilled in the art would be able to readily determine an appropriate material thickness for their particular need. In certain examples, the canister is constructed substantially of steel with a thickness of about 5-25 mils (0.005-0.025"). In other examples, the canister is constructed substantially of steel with a thickness of about 6-20, 7-15, 8-12, or 9-11 mils. In further examples, the canister is constructed substantially of steel with a thickness of about 10 mils.

The canisters of the present application also possess a plurality of transverse holes 100 through the canister sidewall. In certain embodiments, the canister will include at least 4 transverse holes through the sidewall of the canister. In further embodiments, the canister will include at least 5, 6, 7, 8, 9, 10, 12, 14, 16, 18, 20, 22, 24, 26, 28, 30, 32, 34, 36, 38, 40, 42, 44, 46, 48, 50, 55, 60, 65, 70, 75, 80, 85, 90, 95, or 100 transverse holes through the sidewall of the canister. In other embodiments, the canister will include not more than 5, 6, 7, 8, 9, 10, 12, 14, 16, 18, 20, 22, 24, 26, 28, 30, 32, 34, 36, 38, 40, 42, 44, 46, 48, 50, 55, 60, 65, 70, 75, 80, 85, 90, 95, or 100 transverse holes through the sidewall of the canister. In particular examples, the canister will include 4-40, 5-30, or 6-24 transverse holes through the sidewall of the canister. For example, the canister in FIG. 1A contains 4 transverse holes 100 through sidewall 20, the canisters in FIGS. 1B and 1E each contain 6 transverse holes 100 through sidewall 20, the canister in FIG. 1C contains 18 transverse holes 100 through sidewall 20, the canister in FIG. 1D contains 40 transverse holes 100 through sidewall 20, and the canister in FIG. 1F contains 24 transverse holes 100 through sidewall 20.

In certain embodiments, the canister may further include transverse holes 100 through one or both end caps of the canister. In certain examples, the canister will have between 1 and 10 transverse holes in one or both of the end caps. In particular examples, the endcap may contain not more than 10, 9, 8, 7, 6, 5, 4, 3, 2, or 1 transverse hole through it. In other particular examples, the endcap may contain at least 1, 2, 3, 4, 5, 6, 7, 8, 9, or 10 transverse holes through it. For example, endcap 40 in FIG. 5 contains a single transverse hole 100, endcap 40 in FIG. 2B contains 4 transverse holes 100, and endcap 40 in FIG. 2C contains 3 transverse holes 100.

Transverse holes 100 can be any suitable shape. In certain examples, the transverse holes are round. In certain embodiments, each of the plurality of transverse holes will have a diameter that is substantially the same. In other embodiments, the transverse holes can be different diameters. For example, transverse holes 100 through endcap 40 in FIG. 2C are all substantially the same size, while transverse holes 100 through endcap 40 in FIG. 2B are two different sizes. In certain embodiments, the transverse holes will have a diameter of at least about 0.125", 0.25", 0.375", 0.5", 0.625", 0.75", 0.875", or 1.0". In further embodiments the transverse holes will have a diameter of not more than about 0.125", 0.25", 0.375", 0.5", 0.625", 0.75", 0.875", or 1.0". In certain examples, the transverse holes will have a diameter of about 0.125"-1.0", 0.25"-0.75", or 0.25"-0.5".

Figure 1B:
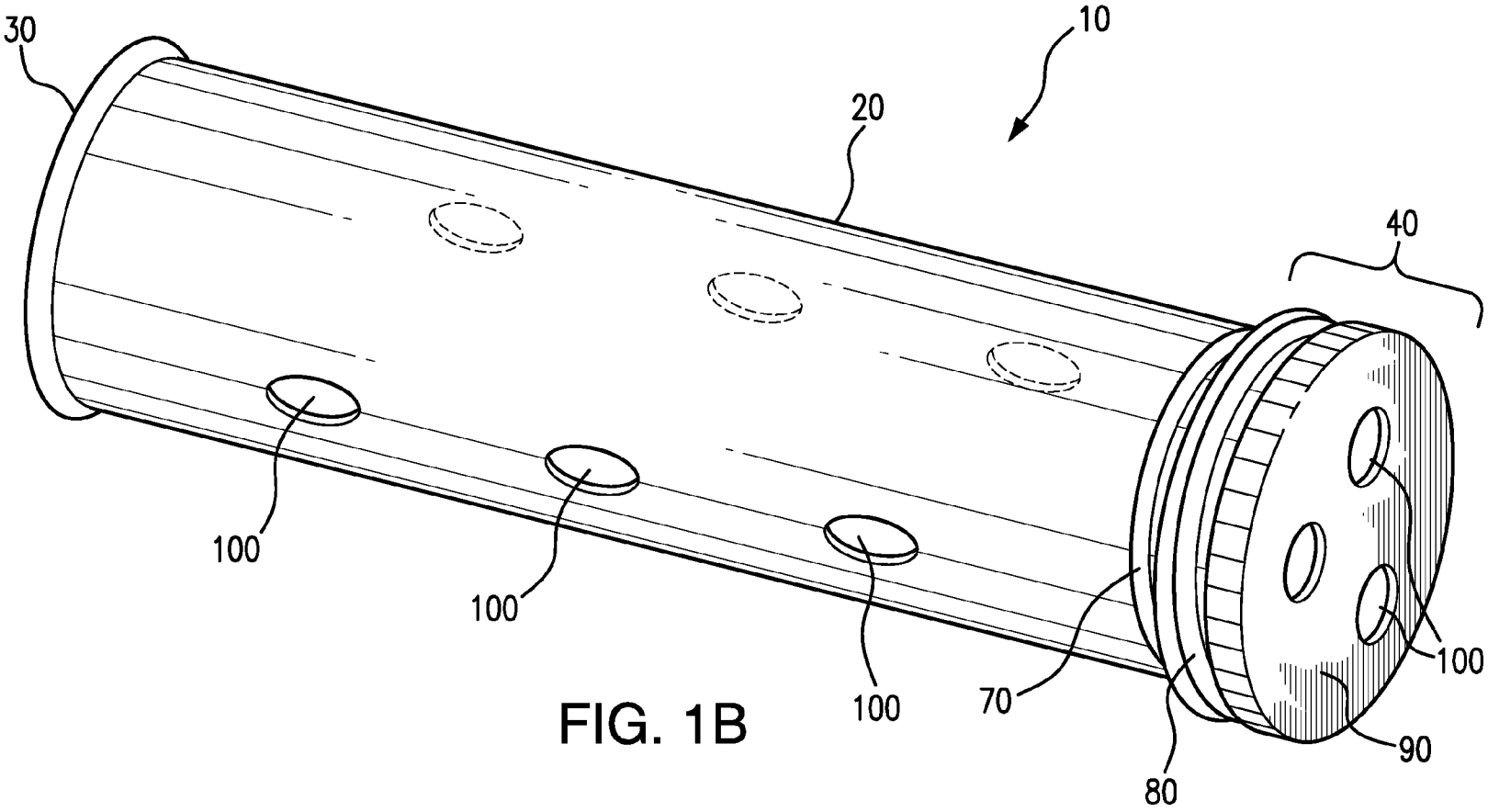
Figure 1C:
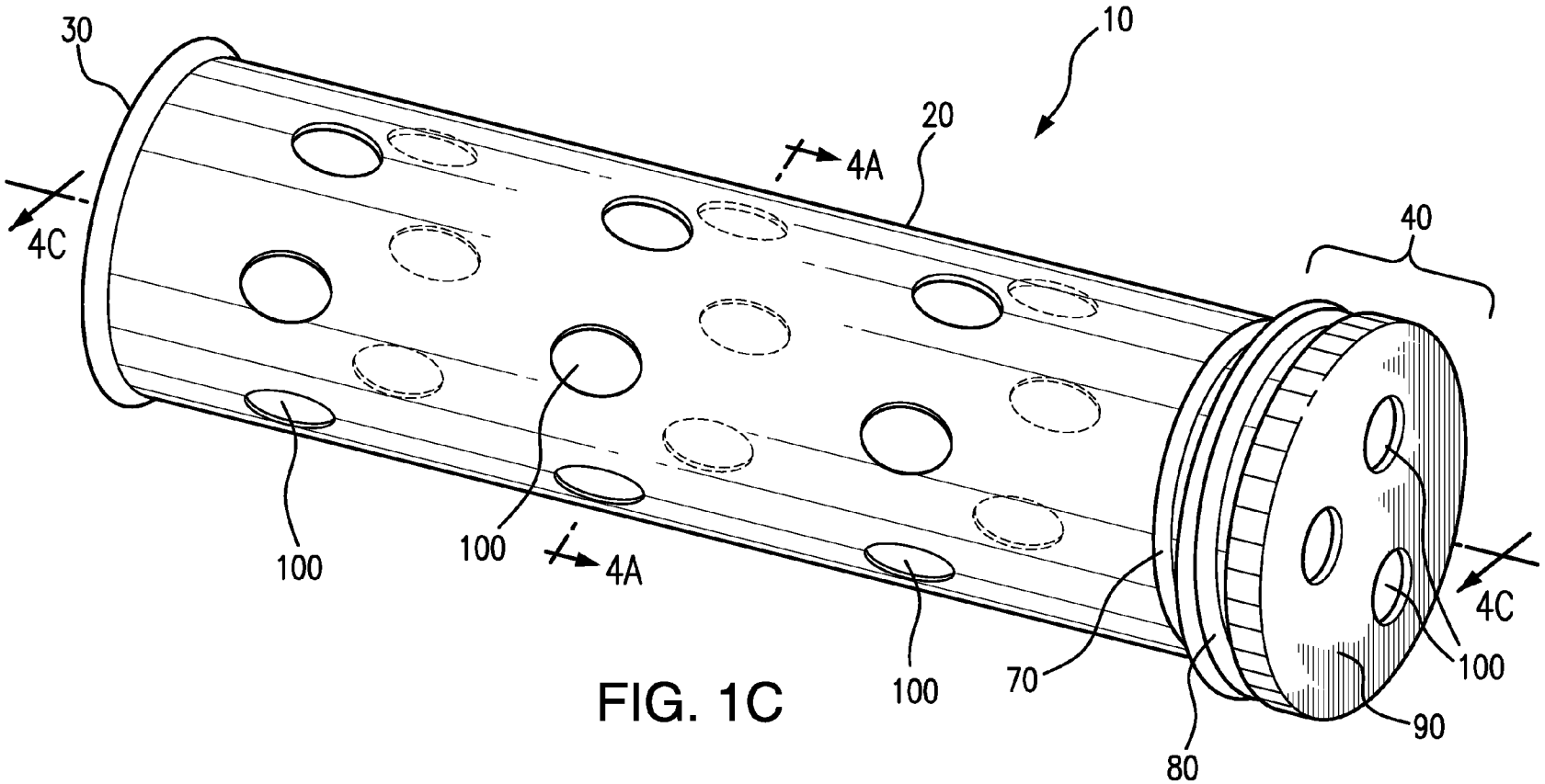
Figure 1D:
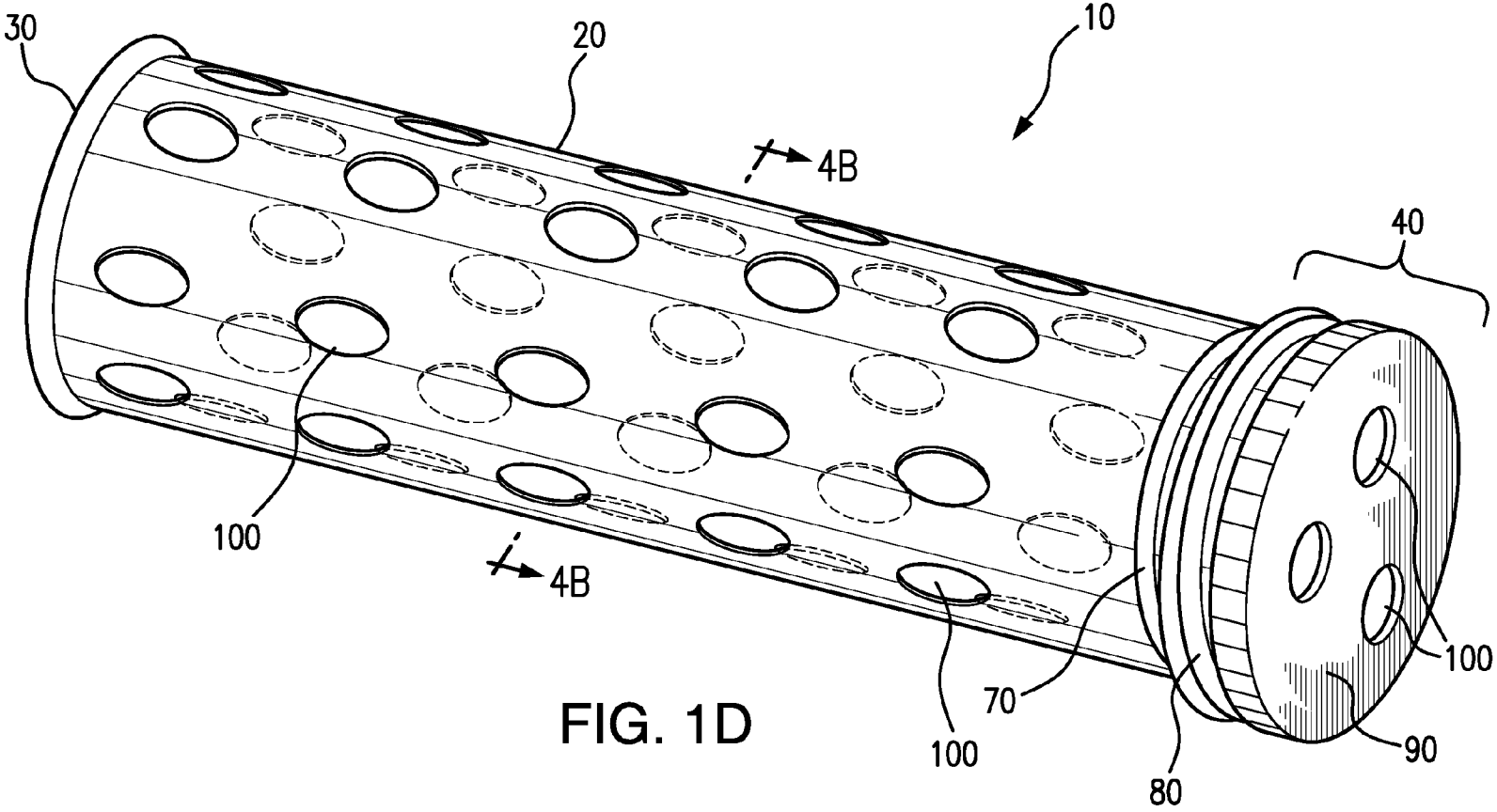
Figure 1E:
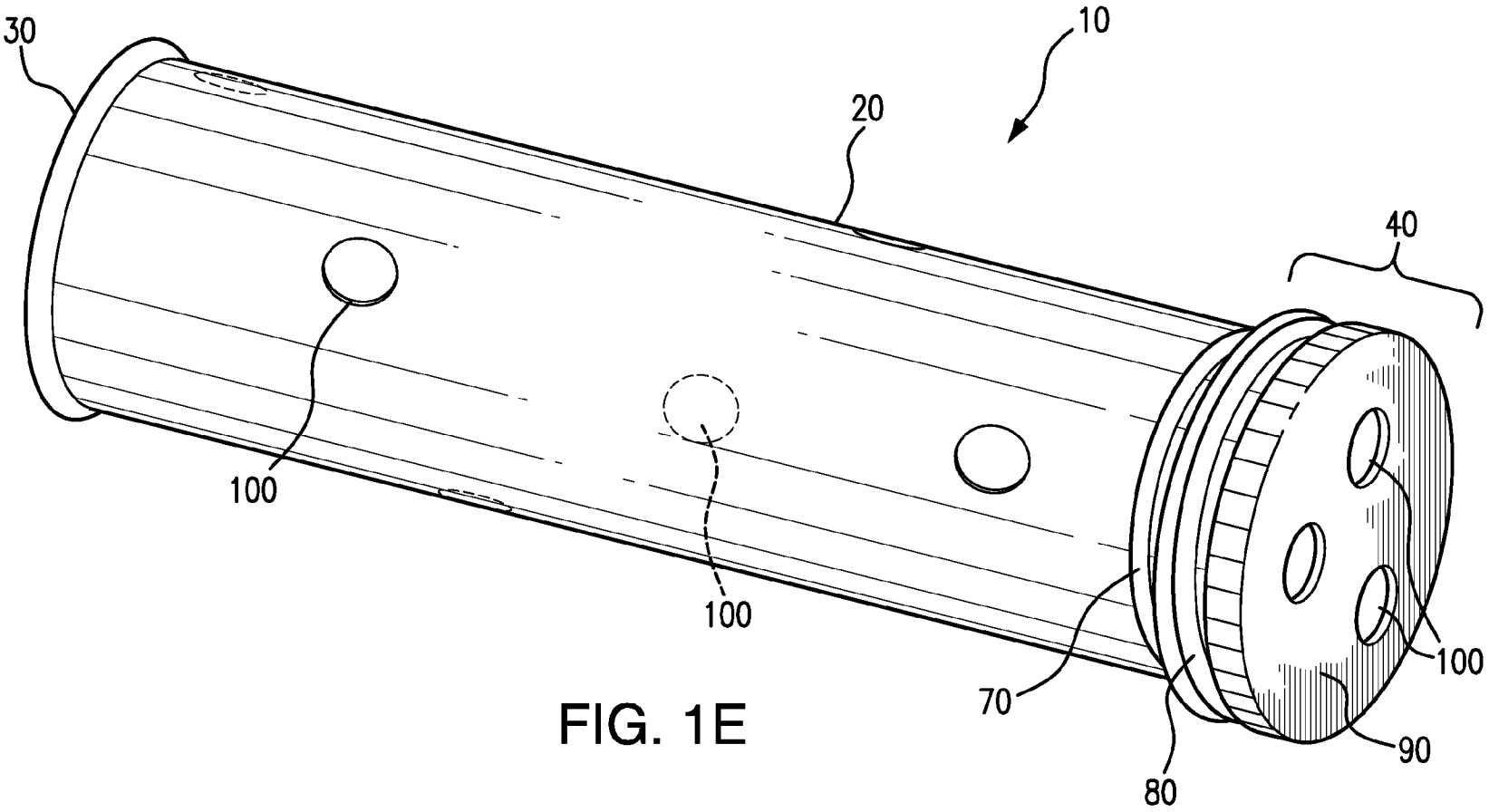
Figure 1F:
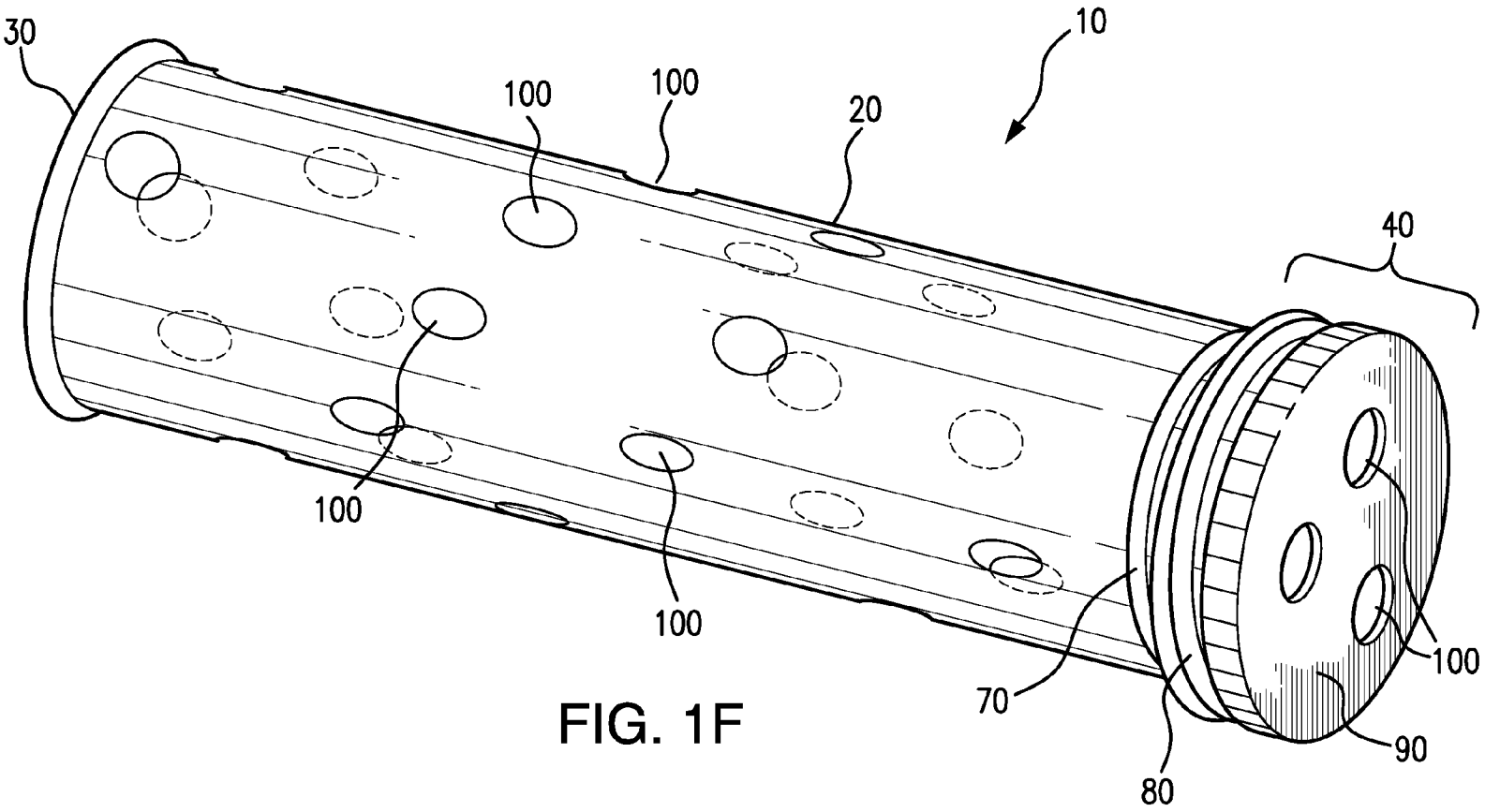
Figure 2:
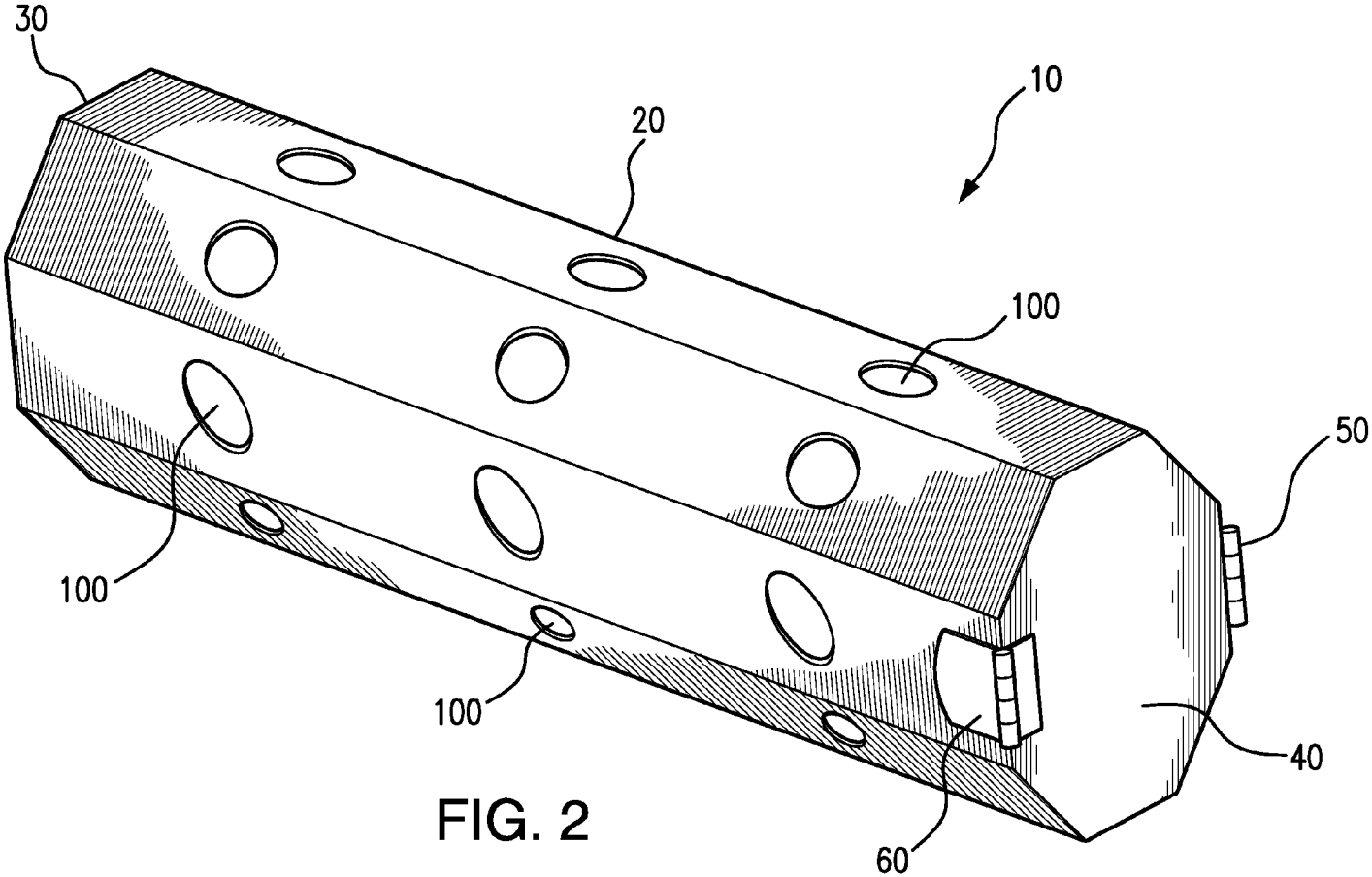
FIG. 2 provides a perspective view of a canister of the present application. This canister possesses an octagonal shape; a hinged, latching top endcap; and 3 rows of transverse holes, each row possessing 8 holes which are placed around the circumference of the canister such that one hole in each row appears on each face of the octagonal canister.
Figure 3C:
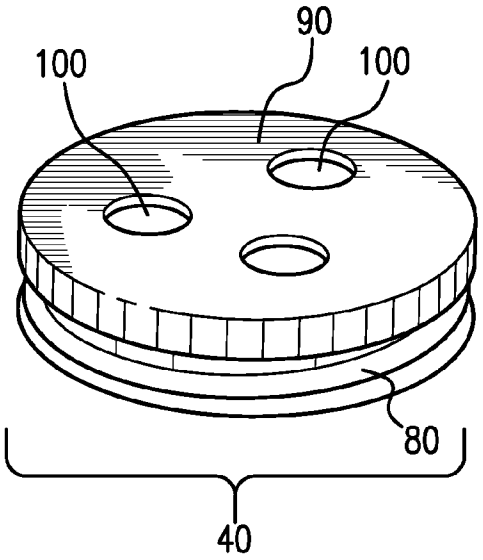
FIGS. 3A-3C provide perspective views of screw-on endcaps possessing from 0-4 transverse holes.
Figure 3B:
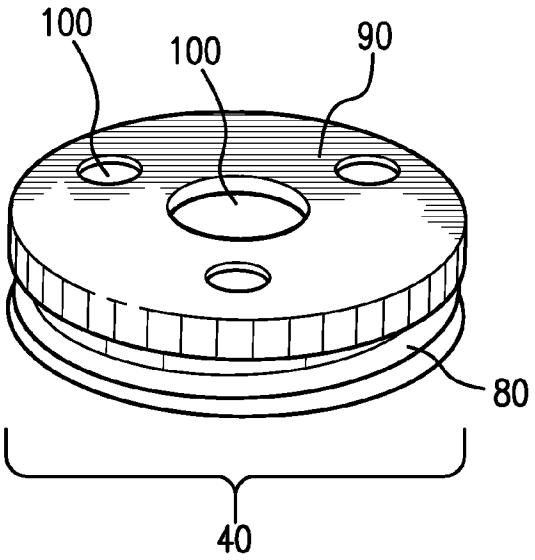
Figure 3A:
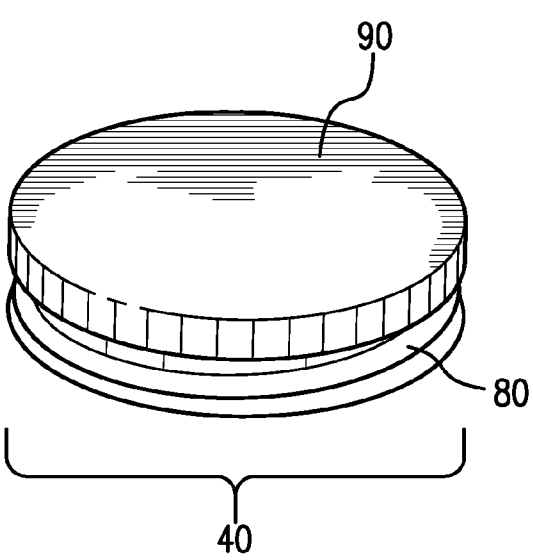

In certain embodiments, transverse holes 100 are provided in a substantially symmetrical pattern. In certain examples, the holes are placed in a spiral pattern along the length and around the circumference of the canister sidewall. For example, the canister illustrated in FIG. 1E possesses 6 transverse holes 100 in a single spiral around and along canister sidewall 20, while the canister illustrated in FIG. 1F possesses 24 transverse holes 100 in a dual-spiral pattern around and along canister sidewall 20. In other examples, the holes are placed in a plurality of rows along the length of the canister sidewall with the holes within each row being substantially evenly spaced around the circumference of the tube (see, e.g., FIGS. 1A-1D). In certain examples, the canister will contain at least 2, 3, 4, 5, 6, 7, 8, 9, 10, 11, or 12 rows of transverse holes. In other examples, the canister will contain no more than 2, 3, 4, 5, 6, 7, 8, 9, 10, 11, or 12 rows of transverse holes. In certain particular examples, the canister will contain 2-12, 3-8, or 4-6 rows of transverse holes. In other examples, the canister will contain at least 2, 3, 4, 5, 6, 7, 8, 9, 10, 11, or 12 transverse holes in each row. In further examples, the canister will contain no more than 2, 3, 4, 5, 6, 7, 8, 9, 10, 11, or 12 transverse holes in each row. In certain particular examples, the canister will contain 2-12, 3-8, or 4-6 transverse holes in each row. As particular examples, the canister shown in FIG. 1A possesses transverse holes 100 in a pattern of 2 rows of holes with each row possessing 2 holes substantially evenly spaced around the circumference of the canister (i.e., approximately 180° apart); FIG. 1B possesses transverse holes 100 in a pattern of 3 rows of holes with each row possessing 2 holes substantially evenly spaced around the circumference of the canister (i.e., approximately 180° apart); FIG. 1C possesses transverse holes 100 in a pattern of 3 rows of holes with each row possessing 6 holes substantially evenly spaced around the circumference of the canister (i.e., approximately 60° apart); and FIG. 1D possesses transverse holes 100 in a pattern of 5 rows of holes with each row possessing 8 holes substantially evenly spaced around the circumference of the canister (i.e., approximately 45° apart).

Figure 4B:
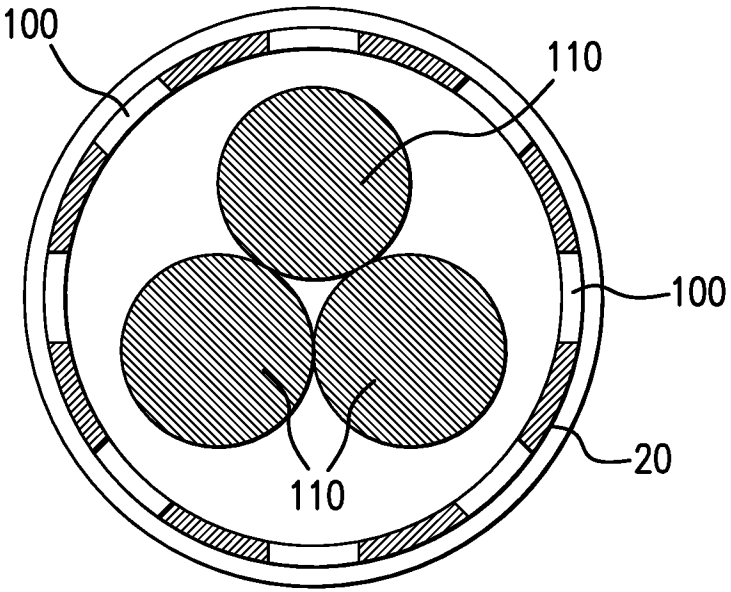
FIGS. 4A-4C illustrate cross-sectional views of canisters of the present application.
Figure 4A:
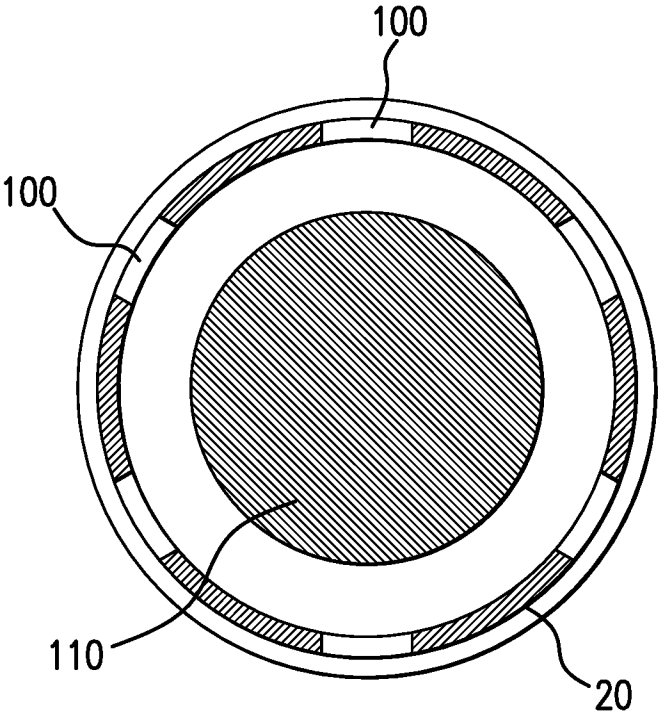
Figure 4C:
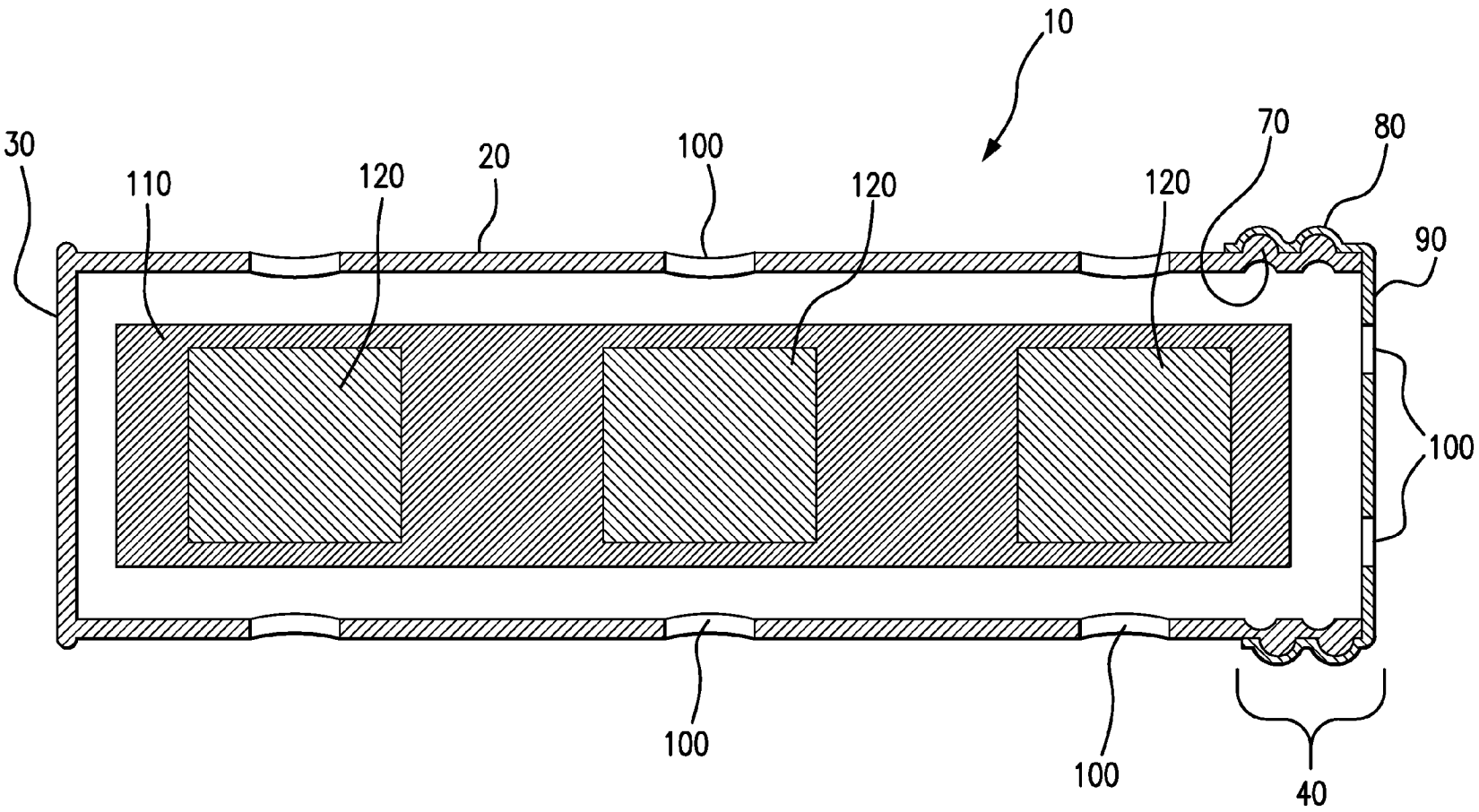
Figure 5:
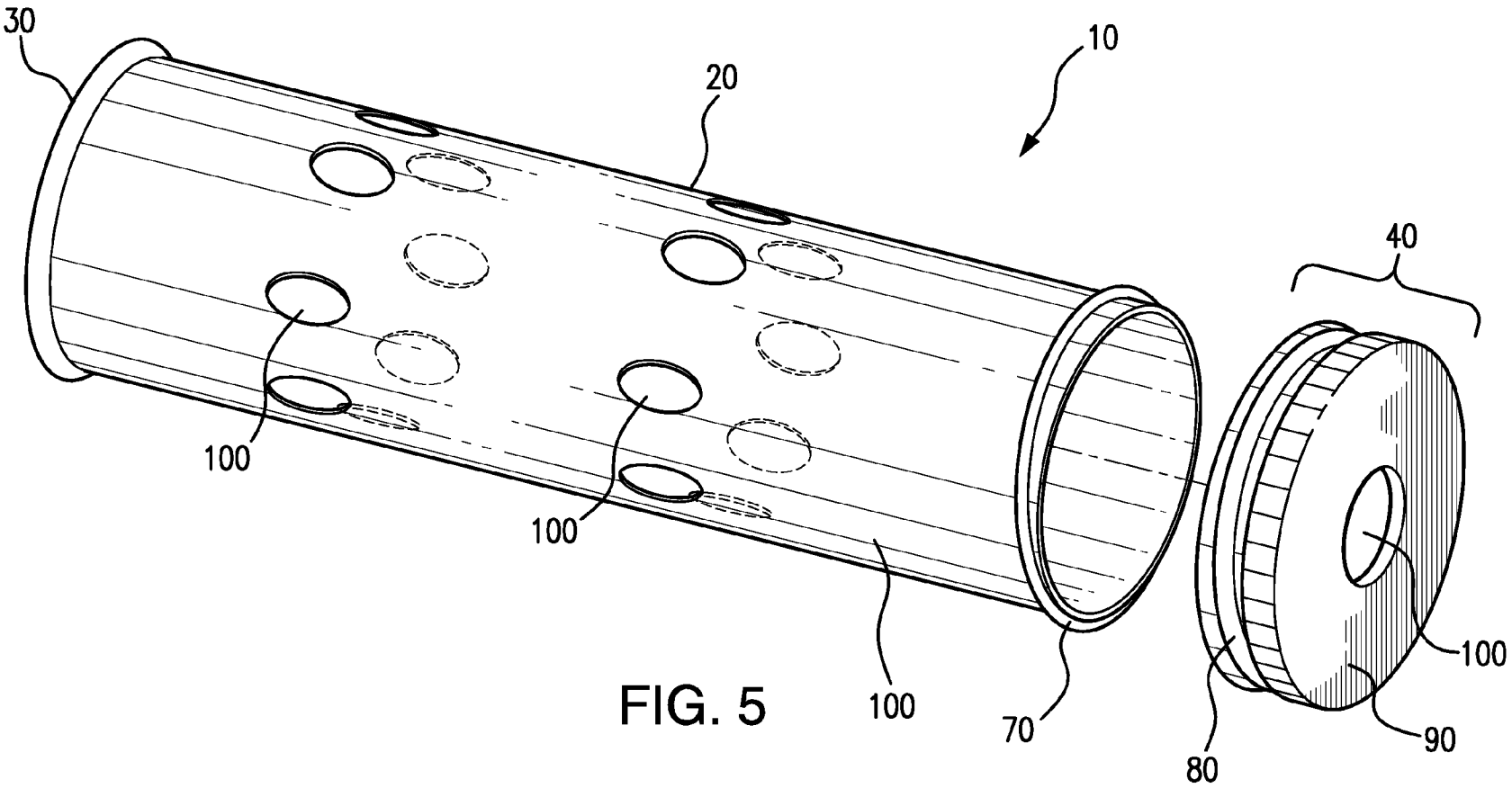
FIG. 5 illustrates a side view of a canister that possesses a threaded top endcap with the endcap in the removed position.

In certain examples, rows of transverse holes are placed such that they substantially align with the major pyrotechnic charges within the incendiary device. For example, FIG. 4C illustrates a cross-sectional view of the canister of FIG. 1C containing a single incendiary device 110. As FIG. 4C illustrates, canister 10 possesses three rows of transverse holes 100 through sidewall 20. Those rows are in substantial alignment with the three major pyrotechnic charges 120 within incendiary device 110. Such an alignment of holes with the major pyrotechnic charges can aid in escape of flame and gas from the canister during burning of the incendiary device. This may further ensure that the gas is able to escape efficiently enough to prevent explosion or propulsion of the canister. This may also allow, for example, a relatively thinner or weaker material to be used in construction of the can, or may allow, for example, a lower hole:pyrotechnic ratio to be employed in the canister.

Within canister 10 is placed one or more incendiary devices 110 containing one or more pyrotechnic charge 120. As used herein, an "incendiary device" is any device that contains pyrotechnic charge material that is used to produce flames, heat, smoke, pressure, etc. As used herein, "pyrotechnic charge material" means compounds or mixture of compounds that are burned to create flame, heat, pressure, smoke, etc., in the incendiary device. Pyrotechnic charge materials may include, but are not limited to, compounds containing black powder, potassium perchlorate, ammonium perchlorate, strontium nitrate, barium nitrate, amorphous boron, magnesium, aluminum, lithium carbonate, and similar materials. In certain examples, the incendiary device is a hand-held incendiary device. In other examples, the incendiary device is a signal flare or firework. In particular examples, the incendiary device is a parachute flare or road flare. In certain specific examples, the incendiary device is a parachute flare.

In certain examples, the canister is constructed so as to contain only a single incendiary device. In other examples, the canister is constructed so as to contain at least 1, 2, 3, 4, 5, 6, 7, 8, 9, 10, or more incendiary devices. In additional examples, the canister is constructed so as to contain no more than 10, 9, 8, 7, 6, 5, 4, 3, 2, or 1 incendiary device. In further examples, the canister is constructed so as to contain 1-10, 1-9, 1-8, 1-7, 1-6, 1-5, 1-4, 1-3, or 1-2 incendiary devices. For example, the canisters illustrated in FIGS. 4A and 4C each possess a single incendiary device 110, while the canister illustrated in FIG. 4B possesses 3 incendiary devices 110.

In certain examples, the incendiary devices being contained each comprise 0.01-2 kg of pyrotechnic charge material. In other examples, the total amount of pyrotechnic charge material contained within the canister (i.e., the sum of all pyrotechnic charge material of all incendiary devices within the canister) is 0.01-2 kg. In further examples, the incendiary devices, individually or in combination, contain at least about 0.01, 0.02, 0.03, 0.04, 0.05, 0.06, 0.07, 0.08, 0.09, 0.1, 0.11, 0.12, 0.13, 0.14, 0.15, 0.2, 0.25, 0.3, 0.35, 0.4, 0.45, 0.5, 0.6, 0.7, 0.8, 0.9, 1.0, 1.1, 1.2, 1.3, 1.4, 1.5, 1.6, 1.7, 1.8, 1.9, or 2.0 kg of pyrotechnic charge material. In additional examples, the incendiary devices, individually or in combination, contain no more than about 0.01, 0.02, 0.03, 0.04, 0.05, 0.06, 0.07, 0.08, 0.09, 0.1, 0.11, 0.12, 0.13, 0.14, 0.15, 0.2, 0.25, 0.3, 0.35, 0.4, 0.45, 0.5, 0.6, 0.7, 0.8, 0.9, 1.0, 1.1, 1.2, 1.3, 1.4, 1.5, 1.6, 1.7, 1.8, 1.9, or 2.0 kg of pyrotechnic charge material. In still further examples, the incendiary devices, individually or in combination, contain 0.02-1.7, 0.03-1.4, 0.04-1.1, 0.05-0.8, 0.06-0.6, 0.07-0.4, or 0.08-0.2 kg of pyrotechnic charge material.

The transverse holes should be of a number and diameter such as to allow gas from the burning incendiary device(s) to exit the canister in a substantially even manner, so as not to cause one or more holes to become a nozzle that will allow the canister to gain substantial propulsive force. To that end, one factor that can be considered is the total area of the transverse holes of the canister in comparison to the total mass of pyrotechnic charge material in the incendiary devices within the canister (referred to herein as the hole:pyrotechnic ratio). A hole:pyrotechnic ratio that is too small will not allow sufficient gas flow out of the can, causing the can to rupture or burst, possibly in a violent or explosive manner. On the other hand, a hole:pyrotechnic ratio that is too large will not leave sufficient canister material to provide the necessary structural support to the canister, which again can result in physical failure of the canister and release of the incendiary device. In certain examples, the hole:pyrotechnic ratio is at least about 5, 6, 7, 8, 9, 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 55, 60, 65, 70, 75, 80, 85, 90, 95, 100, 110, 120, 130, 140, or 150 $in^2$/kg pyrotechnic. In other examples, the hole:pyrotechnic ratio is not more than about 5, 6, 7, 8, 9, 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 55, 60, 65, 70, 75, 80, 85, 90, 95, 100, 110, 120, 130, 140, or 150 $in^2$/kg pyrotechnic. In particular examples, the hole:pyrotechnic ratio is about 5-150, 6-100, 7-50, 8-40, 9-35, 10-30, or 15-25 $in^2$/kg pyrotechnic.

In other particular examples, the canister possesses 6-24 transverse holes, each with a diameter of about 0.25"-0.5", and wherein the canister possesses a hole:pyrotechnic ratio of 7-50 $in^2$/kg. In further examples, the transverse holes of this canister will be present in 3-6 rows of equal numbers, with the holes in each row being substantially evenly spaced around the circumference of the canister.

Canisters of the present invention can be of any suitable size for the device(s) to be contained therein. Selection of appropriate canister size can be readily accomplished by a person skilled in the art, taking into account the size and the number of the device(s) to be contained with the canister. An additional factor that can be considered when selecting the size of the canister is the volume of the canister in comparison to the volume of the incendiary devices contained within the canister (referred to herein as the canister:device volume ratio). A canister:device volume ratio that is too small could restrict gas flow out of the can, causing the can to rupture or burst, possibly in a violent or explosive manner. On the other hand, too large of a canister:device volume ratio could allow the device to shift drastically during transport, possibly causing the device to become damaged. Additionally, too large a ratio causes the overall package to have an unnecessarily large size for shipping and storage. In certain examples, the cansiter:device volume ratio is between about 1.5 and about 10. In other examples, the ratio is at least about 1.5, 1.75, 2.0, 2.25, 2.5, 3.0, 3.5, 4.0, 4.5, 5.0, 5.5, 6.0, 6.5, 7.0, 7.5, 8.0, 8.5, 9.0, 9.5, or 10.0. In other examples, the ratio is not more than about 1.5, 1.75, 2.0, 2.25, 2.5, 3.0, 3.5, 4.0, 4.5, 5.0, 5.5, 6.0, 6.5, 7.0, 7.5, 8.0, 8.5, 9.0, 9.5, or 10.0. In further examples, the ratio is about 1.75-8.0, 2.0-6.0, 2.25-4.0, or 2.5-3.0.

The following examples are offered to illustrate, but not to limit, the claimed embodiments. It is to be understood that the examples and embodiments described herein are for illustrative purposes only, and persons skilled in the art will recognize various parameters that can be altered without departing from the spirit of the disclosure or the scope of the appended claims.

EXAMPLES

Example 1

A cylindrical canister with dimensions of approximately 2.00" diameter by approximately 11.5" long was produced from cold-rolled steel sheet 10 mils thick which was bent into a cylindrical shape and held in place by a continuous weld along substantially the full length of the seam. The canister had a threaded, screw-on top endcap. Six 0.375" diameter transverse holes were created in the sidewall of the canister. The holes were arranged in three rows, with each row containing two holes. The two holes in each row were placed such that they were approximately diametrically opposed (approximately 180° apart) to one another. Additionally, one 0.73" diameter transverse hole was created through the top endcap of the canister.

Within the canister was placed a Pains Wessex Para Red Rocket MK8A incendiary device and the canister's screw-on lid was attached and screwed down tightly.

The incendiary device had dimensions of approximately 1.3" diameter by 11.5" length. The incendiary device contained 84 g of total pyrotechnic charge material, which was divided among multiple charges, including a propulsion charge and a flare charge. Thus, the canister possessed a total hole area of 1.08 $in^2$ and contained 84 g of pyrotechnic charge material, giving a hole:pyrotechnic ratio of 12.86 $in^2$/kg. The canister also had an overall volume of approximately 36 $in^3$, while the incendiary device had a volume of approximately 15.25 $in^3$, thus giving a canister:device volume ratio of approximately 2.36.

A combination of wood and charcoal was placed into a cast iron container, ignited, and allowed to become fully involved in burning. The canister was then set onto the heat source. Two minutes and twenty-eight seconds later, the first indication of pyrotechnic charge material ignition within the canister occurred with a report of a sharp "puffing" sound and 6 to 8 inch long×3 inch diameter flames spewing from two holes in the can body. One second later the two flames had doubled in volume and were joined by a third flame. A half second later there was a fourth flame, all four of which were now about 10 inches long and up to 4 to 5 inches in diameter. At 10 seconds into the burn, a second "puff" of venting gas occurred with the exiting flames growing to a total configuration of about 18 inches in length with flame spewing from all six holes in the canister sidewall and the single hole in the canister endcap. At about 47 seconds of total burn time, the exiting flames began to fade. At about 60 seconds, spewing of flame from the canister had all but ceased.

The canister did not move from its original position during the test. The canister was removed from the heat source at about 16 minutes. The entire canister, though thoroughly scorched, remained intact. Thus, the canister withstood the fire and pyrotechnic flames and prevented the incendiary device from becoming propulsive during the burn.

Example 2

Cylindrical canisters with dimensions of approximately 2.00" diameter by approximately 12.0" long were produced from cold-rolled steel sheet 10 mils thick which was bent into a cylindrical shape and held in place by a continuous weld along substantially the full length of the seam. The canisters had a threaded, screw-on top endcap. Eighteen 0.375" diameter transverse holes were created in the sidewall of the canisters. The holes were arranged in three rows, with each row containing six holes. The six holes in each row were placed such that they were substantially evenly spaced approximately 60° apart around the circumference of the sidewall, thereby forming six columns of holes along the sidewall. Additionally, three 0.375" diameter transverse holes were created through the screw-on endcap of the canisters. These holes were placed in a triangle pattern with center-to-center distance of 0.875" between each adjacent hole.

The incendiary devices used in this example were the Pains Wessex Para Red Rocket MK8A, which had dimensions of approximately 1.3" diameter by 11.5" length. The incendiary device contained 84 g of total pyrotechnic charge material, which was divided among multiple charges, including a propulsion charge and a flare charge. Thus, the canister possessed a total hole area of 2.32 $in^2$ and contained 84 g of pyrotechnic charge material, giving a hole:pyrotechnic ratio of approximately 27.6 $in^2$/kg. The canister also had an overall volume of approximately 37.7 $in^3$, while the incendiary device had a volume of approximately 15.25 $in^3$, thus giving a canister:device volume ratio of approximately 2.47.

Each Pains Wessex Para Red Rocket MK8A incendiary device was placed in a resealable 2.5 mil thick×2.5" wide× 13.0" long clear poly plastic bag and sealed tightly. Each canister was lined prior to incendiary device insertion with a ~0.25" thick×5.62" wide×12.0" long single sided sheet of corrugated cardboard wrap rolled into a tubular shape and inserted into the tubular canister, as cushioning material between the incendiary device and the canister. The canisters' screw-on lids were attached and screwed down tightly. The three canisters were placed adjacent to one another in a single row in a corrugated cardboard box and the box was sealed. The box was buried in a pit of sand with a box of confinement sand placed on top.

The incendiary device in the center tube was initiated by extending the ignition lanyard with a cord. Upon initiation, the box began to ignite and burn with white/gray smoke for a duration of approximately 65 seconds. There was no detonation or fireballs observed during the burn. After burning ceased, and after an approximately 45 minute wait time, the box and its contents were retrieved for inspection. The box was found intact, but charred on its interior. All three canisters remained intact. Upon opening the canisters, the initiated incendiary device was found to have functioned and burned to completion. The incendiary devices in the adjacent two canisters had not sympathetically initiated.

Thus, the canisters withstood the fire and pyrotechnic flame to remain basically as originally tested. Moreover, the canister of the ignited device contained the fire sufficiently to prevent sympathetic ignition of the incendiary devices in adjacent canisters.

Example 3

Twenty four canisters each containing a Pains Wessex Para Red Rocket MK8A incendiary device were used in this example, as described in Example 2. As in Example 2, each incendiary device was placed in a sealed clear poly plastic bag and each canister was lined with a sheet of corrugated cardboard wrap as cushioning material between the incendiary device and the canister. The canisters' screw-on lids were attached and screwed down tightly. Eight canisters were then placed into each of three corrugated boxes. The eight canisters were placed in the boxes in two rows of four canisters each and the boxes were sealed.

The three boxes were placed onto a stack of wood that had been doused with diesel fuel and the wood stack was ignited. Over the course of several minutes, the burning wood caused ignition of all 24 of the incendiary devices within the boxes. During this period, heavy white/gray smoke and bright reddish flames were observed from the boxes/canisters. No detonations or fireballs were observed and no incendiary device or canister became propulsive during the test.

After the burning was complete, all 24 canisters were recovered in the center of the ash pile. All 24 canisters remained generally intact, though seven of the recovered canisters were partially compromised by the intense heat of the burning energetics. Additionally, one of the canisters was recovered without its threaded lid.

Thus, the canisters again withstood the fire and pyrotechnic flames and prevented the incendiary devices from becoming propulsive during the burn.

Example 4

In the tests detailed above, each canister's longitudinal tube body seam was overlap welded. However, other methods for attaching the canister body along the longitudinal seam can be used, as well. In this example, a cylindrical canister with dimensions of approximately 2.00" diameter by approximately 12.0" long was produced from cold-rolled steel sheet 10 mils thick which was bent into a cylindrical shape and held in place by a folded seam. More specifically, the sheet material was bent on both opposing edges along its full length and then the two bent edges were interlocked into a "double overlap folded seam lock." The seam was then crushed so as to form a gas and/or a liquid seal.

The canister had a threaded, screw-on top endcap. Eighteen 0.375" diameter transverse holes were created in the sidewall of the canister. The holes were arranged in three rows, with each row containing six holes. The six holes in each row were placed such that they were substantially evenly spaced approximately 60° apart around the circumference of the sidewall, thereby forming six columns of holes along the sidewall. Additionally, three 0.375" diameter transverse holes were created through the screw-on endcap of the canisters. These holes were placed in a triangle pattern with center-to-center distance of 0.875" between each adjacent hole.

The incendiary devices used in this example were the Pains Wessex Para Red Rocket MK8A, which had dimensions of approximately 1.3" diameter by 11.5" length. The incendiary device contained 84 g of total pyrotechnic charge material, which was divided among multiple charges, including a propulsion charge and a flare charge. Thus, the canister possessed a total hole area of 2.32 $in^2$ and contained 84 g of pyrotechnic charge material, giving a hole:pyrotechnic ratio of approximately 27.6 $in^2$/kg. The canister also had an overall volume of approximately 37.7 $in^3$, while the incendiary device had a volume of approximately 15.25 $in^3$, thus giving a canister:device volume ratio of approximately 2.47:1.

Test #1: In this test, the flare's internal pyrotechnics were ignited by pulling the flare's lanyard, the normal means for rocket flare ignition. Directly after the flare's ignition lanyard was pulled, a "puff" of white smoke was observed, growing over an eight second period to a six foot diameter plume, exiting the canister primarily out of the three holes in the screw-on endcap. Directly thereafter flame spouts driven by internal gas pressure within the canister exited all 21 vent holes, these spouts ranging in length from 6 to 12 inches long and lasting for approximately 20 seconds. Thereafter, simple flames, not being driven by exiting gases, continued to burn, exiting the canister's 21 ea. holes for about 2 minutes.

Inspection of the canister following the test revealed that that incendiary device functioned and burned to completion, and no portion of the canister showed deformation. Thus, the canister withstood the pyrotechnic flames and prevented the incendiary device from becoming propulsive during the burn.

Test #2: In this test, the canister containing the incendiary device was placed in a fire fueled by a combination of charcoal briquettes, which burn at approximately 1200° F., as well as cured red and white oak lumber, which burn at approximately 800 to 900° F., all of which was ignited and allowed to become fully involved prior to placing the canister on the fire.

Three minutes, twenty-eight seconds after the canister was laid upon the fire, ignition of the incendiary device occurred from one end of the canister to the other. Within two more seconds, the flaming discharge had grown from an initial ejection of 3 to 4 inch long flames spewing from all the canister's 21 holes to a fireball growing to a maximum diameter of 3 to 4 feet over a period of about ten seconds, then dying back to flames being driven from all the holes under pressure resulting in a fireball about 2 feet in diameter, lasting about 40 seconds. Flames not driven by internal canister gas pressure continued to be emitted from the canister for about 3 minutes thereafter.

Inspection of the canister following the test revealed that that incendiary device functioned and burned to completion, and no portion of the canister showed deformation. Thus, the canister withstood the pyrotechnic flames and prevented the incendiary device from becoming propulsive during the burn.

We claim:

1. A protective canister configured for incendiary devices, said canister comprising a circumferential sidewall and two endcaps, said endcaps attached to said sidewall so as to form a substantially enclosed canister;

wherein one or both of said endcaps is removably attached to said sidewall;

wherein said sidewall comprises a plurality of transverse holes through it;

wherein said canister contains between 1 and 10 incendiary devices enclosed within it;

wherein said canister has a hole:pyrotechnic ratio of between about 5 $in^2$/kg and about 150 $in^2$/kg; and wherein said canister has a canister:device volume ratio of about 1.5 to about 10.

2. The canister of claim 1, wherein said removably attached endcap is a screw-on endcap and wherein one or both of said endcaps further comprises one or more transverse holes through it.

3. The canister of claim 1, wherein said incendiary devices are hand-held incendiary devices selected from the group consisting of a parachute flare and a road flare.

4. The canister of claim 3, wherein said incendiary device is a parachute flare.

5. The canister of claim 1, wherein said incendiary devices within said canister comprise a total of 0.08-0.2 kg of pyrotechnic charge material.

6. The canister of claim 1, wherein said sidewall is formed into a substantially cylindrical shape.

7. The canister of claim 1, wherein said sidewall is formed into a regular polygon shape with 3-12 sides.

8. The canister of claim 1, wherein said canister comprises 6-24 transverse holes.

9. The canister of claim 8, wherein each of said plurality of transverse holes comprises a diameter of about 0.25-0.5".

10. The canister of claim 1, wherein said canister has a hole:pyrotechnic ratio of between about 10 $in^2$/kg and about 30 $in^2$/kg.

11. The canister of claim 1, wherein said plurality of transverse holes are arranged in 2-10 rows along the length of the canister sidewall with each row containing 2-10 transverse holes, said transverse holes in each of said rows being substantially evenly spaced around the circumference of the canister sidewall.

12. The canister of claim 11, wherein said rows are arranged along the length of the canister sidewall such that they substantially align with the major pyrotechnic charges within the incendiary device.

13. The canister of claim 1, wherein the canister is constructed substantially of steel with a thickness of about 5 to about 20 mils.

14. The canister of claim 13, wherein said steel material has a thickness of about 10 mils.

15. The canister of claim 1, wherein said canister has a canister:device volume ratio of about 2 to about 5.

16. The canister of claim 1;

wherein said sidewall is formed into a substantially cylindrical shape;

wherein one of said endcaps is removably attached to said sidewall, said removable attachment being a screw-on attachment;

wherein said sidewall and endcaps are constructed substantially of steel, said steel having a thickness of about 5 to about 20 mils;

wherein said canister contains a parachute flare enclosed within it, said parachute flare comprising about 0.08-0.2 kg pyrotechnic charge material;

wherein said sidewall comprises 6-24 transverse holes through it;

wherein said transverse holes are arranged in 2-6 rows along the length of the canister sidewall with each row containing 2-6 transverse holes, said transverse holes in each of said rows being substantially evenly spaced around the circumference of the sidewall;

wherein said rows are arranged along the length of the canister sidewall such that they substantially align with the major pyrotechnic charges within the incendiary device;

wherein each of said transverse holes comprises a diameter of about 0.25-0.5";

wherein said canister has a hole:pyrotechnic ratio of about 10 $in^2$/kg to about 30 $in^2$/kg;

and wherein said canister has a canister:device volume ratio of about 2 to about 5.

17. A method for transporting or storing an incendiary device, the method comprising placing an incendiary device within a canister as defined in claim 16.

* * * * *